US007050742B2

(12) United States Patent
Gila et al.

(10) Patent No.: US 7,050,742 B2
(45) Date of Patent: May 23, 2006

(54) HARD IMAGING APPARATUS CHARGING DEVICES AND HARD IMAGING DEVICE CHARGING METHODS

(75) Inventors: Omer Gila, Cupertino, CA (US); David S. Vejtasa, Springfield, MO (US); Michael H. Lee, San Jose, CA (US); Thomas Camis, Boise, ID (US); Peter Gysling, New Plymouth, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 179 days.

(21) Appl. No.: 10/700,968

(22) Filed: Oct. 31, 2003

(65) Prior Publication Data

US 2005/0095036 A1 May 5, 2005

(51) Int. Cl.
*G03G 15/02* (2006.01)

(52) U.S. Cl. ..... 399/168; 399/159

(58) Field of Classification Search ..... 399/168, 399/176, 159; 361/212, 220, 221, 225
See application file for complete search history.

(56) References Cited

U.S. PATENT DOCUMENTS

| | | | | |
|---|---|---|---|---|
| 5,146,280 | A | 9/1992 | Kisu | |
| 5,666,608 | A | 9/1997 | Christensen | |
| 5,682,581 | A * | 10/1997 | Honma et al. | 399/159 |
| 5,845,177 | A * | 12/1998 | Choi | 399/176 |
| 6,405,006 | B1 | 6/2002 | Tabuchi | |
| 6,546,219 | B1 | 4/2003 | Sato et al. | |
| 6,560,419 | B1 | 5/2003 | Sugiura | |
| 6,628,912 | B1 * | 9/2003 | Amemiya et al. | 399/176 |
| 6,795,669 | B1 * | 9/2004 | Yamauchi et al. | 399/159 |
| 2002/0037180 | A1 * | 3/2002 | Amemiya et al. | 399/176 |
| 2002/0051654 | A1 * | 5/2002 | Niimi et al. | 399/159 |
| 2003/0072587 | A1 | 4/2003 | Sugiura et al. | |
| 2003/0180071 | A1 * | 9/2003 | Suda | 399/159 |
| 2003/0190539 | A1 * | 10/2003 | Niimi | 399/159 |
| 2004/0071476 | A1 * | 4/2004 | Iwasaki et al. | |
| 2004/0109706 | A1 * | 6/2004 | Kosuge et al. | 399/168 |

FOREIGN PATENT DOCUMENTS

| | | | |
|---|---|---|---|
| EP | 1191403 | A2 * | 3/2002 |
| EP | 1331526 | | 7/2003 |
| JP | 2002099135 | A * | 4/2002 |
| JP | 2002251055 | A * | 9/2002 |
| JP | 2002278221 | A * | 9/2002 |
| JP | 2003295583 | A * | 10/2003 |
| JP | 2004246248 | A * | 9/2004 |

* cited by examiner

*Primary Examiner*—Susan Lee

(57) ABSTRACT

Aspects of the invention relate to hard imaging apparatus charging devices, imaging assemblies, imaging assemblies charging methods, and hard imaging device image bearing member charging methods. In one aspect, a hard imaging apparatus charging device is disclosed. The charging device includes first and second end members, and an intermediate member connecting the first and second end members. The intermediate member may have a length corresponding to an imaging area of the image bearing member of the hard imaging apparatus. The intermediate member may be configured to charge the imaging area used to form latent images on the image bearing member during hard imaging operations of the hard imaging apparatus. The first and second end members of the charging device may be configured to maintain a predetermined spaced charging clearance between the intermediate member and the imaging area of the image bearing member. The first and second end members and the intermediate member of the charging device include a monolithic layer.

35 Claims, 5 Drawing Sheets

HARD IMAGING APPARATUS CHARGING DEVICES AND HARD IMAGING DEVICE CHARGING METHODS

FIELD OF THE INVENTION

Aspects of the invention relate to hard imaging apparatus charging devices, imaging assemblies, imaging assembly charging methods, and hard imaging device image bearing member charging methods.

BACKGROUND OF THE INVENTION

Charge rollers (CRs) are used to charge a photoconductor in hard imaging systems (e.g., laser-printer imaging systems). Similar to Scorotron/Corona charging, charge rollers use air ionization to charge a photoconductor. However, a charge roller has increased charging efficiency (close to 100% charging efficiency) and uses lower voltages (~1500V) compared with Scorotron charging (~6500V). Physical contact of a charge roller with a photoconductor may cause print quality defects that are mainly driven by the interaction of the charge roller with materials remaining on the photoconductor after cleaning operations of the photoconductor. Materials remaining on the photoconductor may create sticky polymers which coat the photoconductor. These interactions are even more intensive with liquid electrophotographic processes where, after cleaning the photoconductor, imaging oil comprising dissolved materials and charge directors may still be present on the photoconductor surface giving rise to several print quality issues.

In general, a charge roller contacting a photoconductor may interact with a remaining image formed on the photoconductor, thereby creating ghosting effects (e.g., with the circumference of the charge roller). Further, the charge roller contacting the photoconductor may also interact with other materials (e.g., imaging oil) that remain on the photoconductor, contaminate the photoconductor with leak materials (e.g., conductive ions from the charge roller rubber), and create pin holes in the photoconductor in the charge roller/photoconductor nip. The above drawbacks may contribute to photoconductor quality issues by interfering with the photoconductor/blanket image transfer, interfering with image development, and interfering with cleaning of the photoconductor. The above drawbacks may also cause problems relating to photoconductor lateral conductivity, and uneven photoconductor charging. As a result, lifetime of consumables may decrease and the printing cost per page may increase. Other problems with liquid electrophotographic processes using a photoconductor with a seam area include print quality defects due to accumulation of imaging fluid in defects or wrap-over sections (e.g., seam regions) on the photoconductor. Movement of the charge roller over a section of the photoconductor may elevationally attract some of the accumulated materials and duplicate them into an image area. The extra imaging oil may not only cause disturbance of normal imaging processes but also cause disruption of the Paschen curve and the photoconductor charging voltages, thereby leading to permanent photoconductor damage.

SUMMARY OF THE INVENTION

At least some embodiments of the invention relate to hard imaging apparatus charging devices, imaging assemblies, imaging assembly charging methods, and hard imaging device image bearing member charging methods.

In one aspect, a hard imaging apparatus charging device is disclosed. The charging device may include first and second end members, and an intermediate member connecting the first and second end members. The intermediate member may have a length corresponding to an imaging area of the image bearing member. The intermediate member may be configured to charge the imaging area used to form latent images on the image bearing member during hard imaging operations of the hard imaging apparatus. The first and second end members of the charging device may be configured to maintain a predetermined spaced charging clearance between the intermediate member and the imaging area of the image bearing member. The first and second end members and the intermediate member of the charging device may include a monolithic layer. The charging device may include an outer layer configured to charge the image bearing member. The layer may be formed such that the first and second end members have a large radius than a radius of the intermediate member.

In another aspect, an imaging assembly charging method is described. The charging method may include first providing a photoconductor having a plurality of portions of different radii, second providing a charging device configured to charge the photoconductor, rotating the photoconductor adjacent the charging device to charge the photoconductor, and third providing a clearance between the photoconductor and the charging device during charging of the photoconductor, wherein the clearance may be provided using at least one of the photoconductor or the charging device. The charging method may include configuring the photoconductor to have first and second end portions and an intermediate portion. The first and second end portions may be configured to have a larger radius than a radius of the intermediate portion, the radii measured from a central axis of the photoconductor.

Other aspects of the invention are disclosed herein as is apparent from the following description and figures.

DETAILED DESCRIPTION OF THE INVENTION

Figure 1:
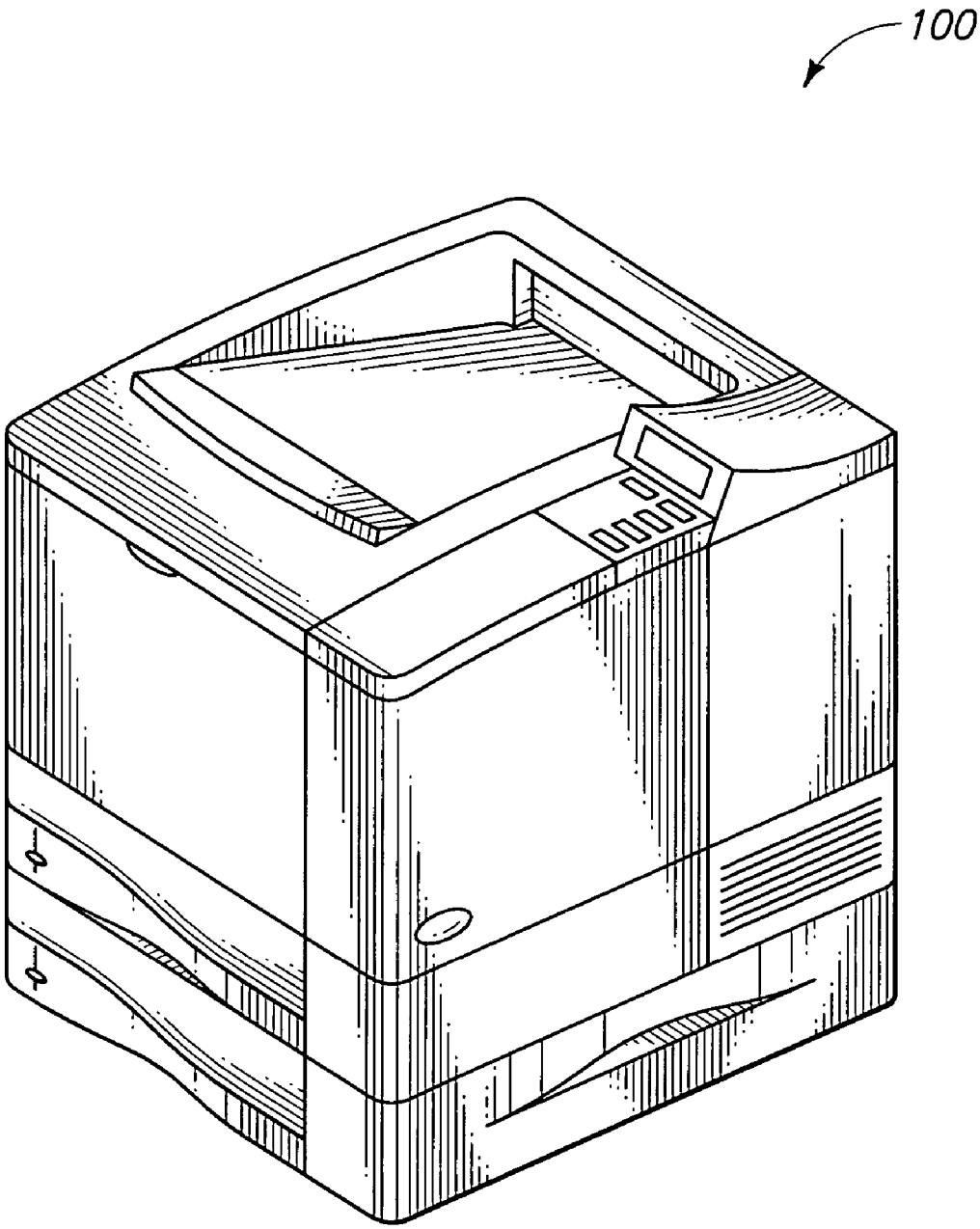
FIG. 1 is an exemplary diagram of a hard imaging device in accordance with one embodiment.

Referring to FIG. 1, an exemplary hard imaging device or apparatus 100 is shown in accordance with one embodiment of the invention. The hard imaging device 100 may be a laser printer. Other configurations to form hard images upon a media 212 (FIG. 1) are possible, and include for example, multi-function peripherals, copiers, facsimile devices, etc. Hard imaging device 100 may be embodied as a device configured to use a dry or liquid marking agent (e.g., toner)

in exemplary configurations. Additional details regarding an exemplary configuration of the hard imaging device 100 are described below with respect to FIG. 2.

Figure 2:
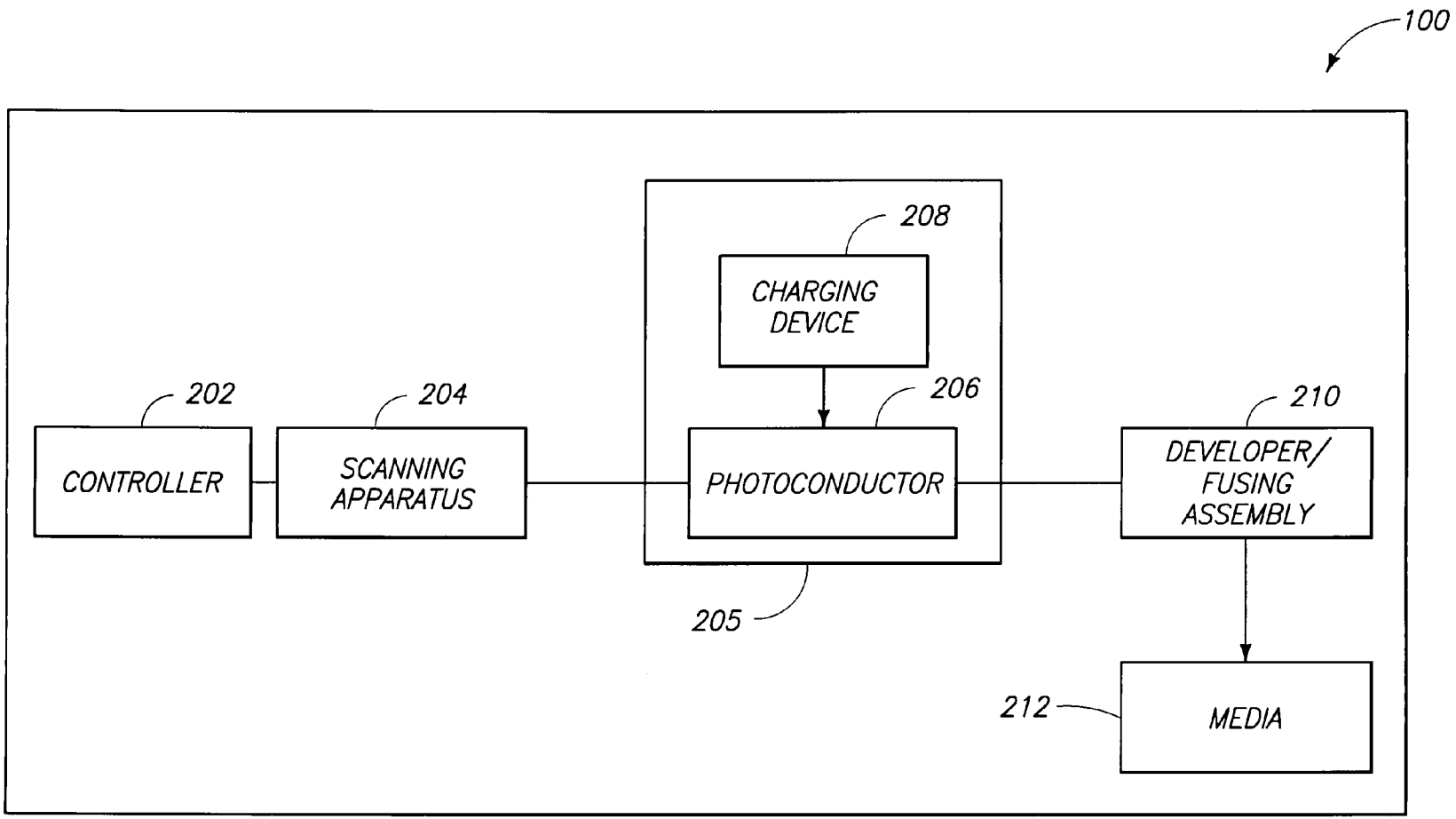
FIG. 2 is a high-level block diagram of a hard imaging device according to one embodiment.

Referring to FIG. 2, an exemplary high-level block diagram of the hard imaging device 100 is shown according to one embodiment of the invention. The depicted hard imaging device 100 configured as a laser printer includes a controller 202, a scanning apparatus 204, an imaging assembly 205, and a developer/fusing assembly 210 configured to form hard images on media 212.

The controller 202 may be configured to control operations of individual components (e.g., 204, 205, 210) of the hard imaging device 100. Exemplary operations of controller 202 include image data processing operations (e.g., rasterization) of data received from an external source (not shown), internally generated, or otherwise accessed. Further details of controller 202 are described below at FIG. 3.

The scanning apparatus 204 may be configured to scan information formatted by controller 202 onto a photoconductor 206 to form latent images. Apparatus 204 may comprise a laser or other light source configured to output a light beam to scan the information in one embodiment.

The imaging assembly 205 includes photoconductor 206 and a charging device 208 in one embodiment. Photoconductor 206 is alternately referred to herein as an image bearing member. Charging device 208 may also be referred to as a charge roller.

Photoconductor 206 includes a rotating imaging surface (e.g., reference numeral 408 of FIG. 4) configured to receive information scanned by the scanning apparatus 204 in one embodiment. Imaging surface 408 is alternatively referred to herein as imaging area or imaging region. In one embodiment, photoconductor 206 may be cylindrical in shape. An exemplary photoconductor 206 comprises a steel cylinder having outwardly exposed photoconductive material (e.g., provided in a layer). Other embodiments of image bearing member or photoconductor 206 are possible. In one embodiment, photoconductor 206 may also include a non-imaging surface (e.g., reference numeral 406 of FIG. 5A). The non-imaging surface 406 is alternatively referred to herein as non-imaging area or non-imaging region. One or more lines of information (e.g., information formatted by the controller 202) may be scanned by laser scanning apparatus 204 onto imaging region 408 of photoconductor 206 forming a latent image thereon in an exemplary electrophotographic process. In the described exemplary embodiments, no information is scanned upon region 406.

The charge roller 208 may be configured to charge photoconductor 206 to enable forming of latent images on the photoconductor 206. The charge roller 208 may be rotatably positioned adjacent photoconductor 206 to charge the photoconductor 206. Following charging of photoconductor 206, latent images are formed upon photoconductor 206 using scanning apparatus 204. Further details of exemplary charge rollers 208 are set forth below at FIGS. 4, 5A–5C.

The developer/fusing assembly 210 may be configured to develop information written onto the photoconductor 206 using a marking agent (e.g., toner), and transfer and fuse the developed image to media 212 (e.g., hard-imaging media such as paper, transparencies, etc.).

Figure 3:
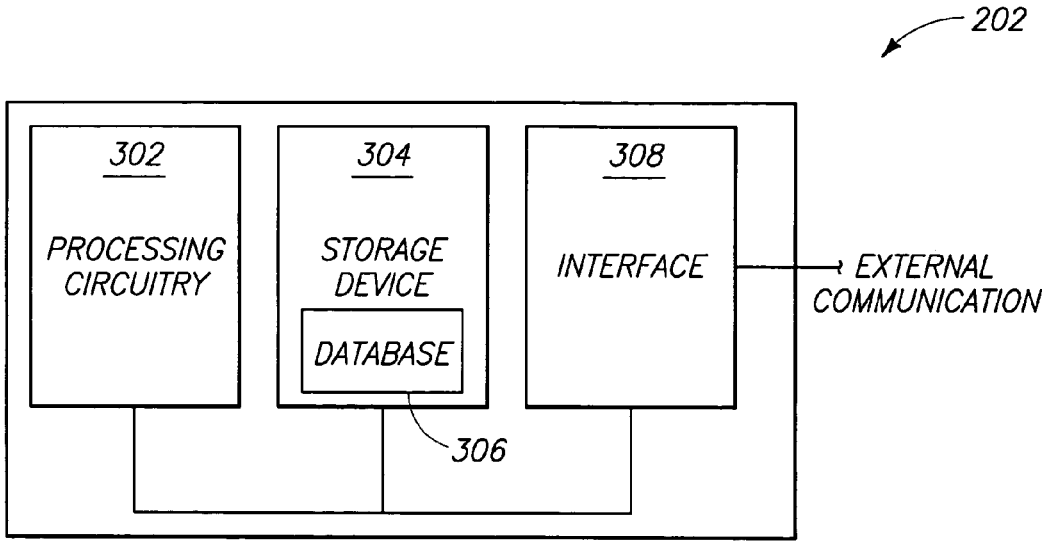
FIG. 3 is a functional block diagram of a controller of the hard imaging device according to one embodiment.

FIG. 3 is a detailed functional block diagram of exemplary controller 202 configured to control operations of the hard imaging device 100. In one embodiment, the controller 202 includes processing circuitry 302, a storage device 304 having a database 306, and an interface 308. Other implementations of controller 202 are possible.

Processing circuitry 302 may be configured to output data to scanning apparatus 204 and to issue command signals to photoconductor 206 and charge roller 208 to control respective operations thereof (e.g., charging of photoconductor 206 using charge roller 208, forming of latent images on the photoconductor 206, etc.).

In one embodiment, processing circuitry 302 may comprise circuitry configured to execute provided programming. For example, processing circuitry 302 may be implemented as a microprocessor or other structure configured to execute executable instructions of programming including, for example, software and/or firmware instructions. Other exemplary embodiments of processing circuitry 302 include hardware logic, PGA, FPGA, ASIC, and/or other structures. These examples of processing circuitry 302 are for illustration and other configurations are possible for implementing operations discussed herein.

The storage device 304 may be configured to store electronic data, file systems having one or more electronic files, programming such as executable instructions (e.g., software and/or firmware for use by processing circuitry 302), and/or other digital information and may include processor-usable media. For example, electronic data and/or file systems may be stored in the form of a table in database 306 of the storage device 304, and stored information may be configured for retrieval by the processing circuitry 302. Processor-usable media includes any article of manufacture which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

Interface 308 may be configured to communicate electronic data externally of the controller 202, for example, with respect to external devices of hard imaging device 100, to communicate control signals to form latent images on the photoconductor 206, etc.

Figure 4:
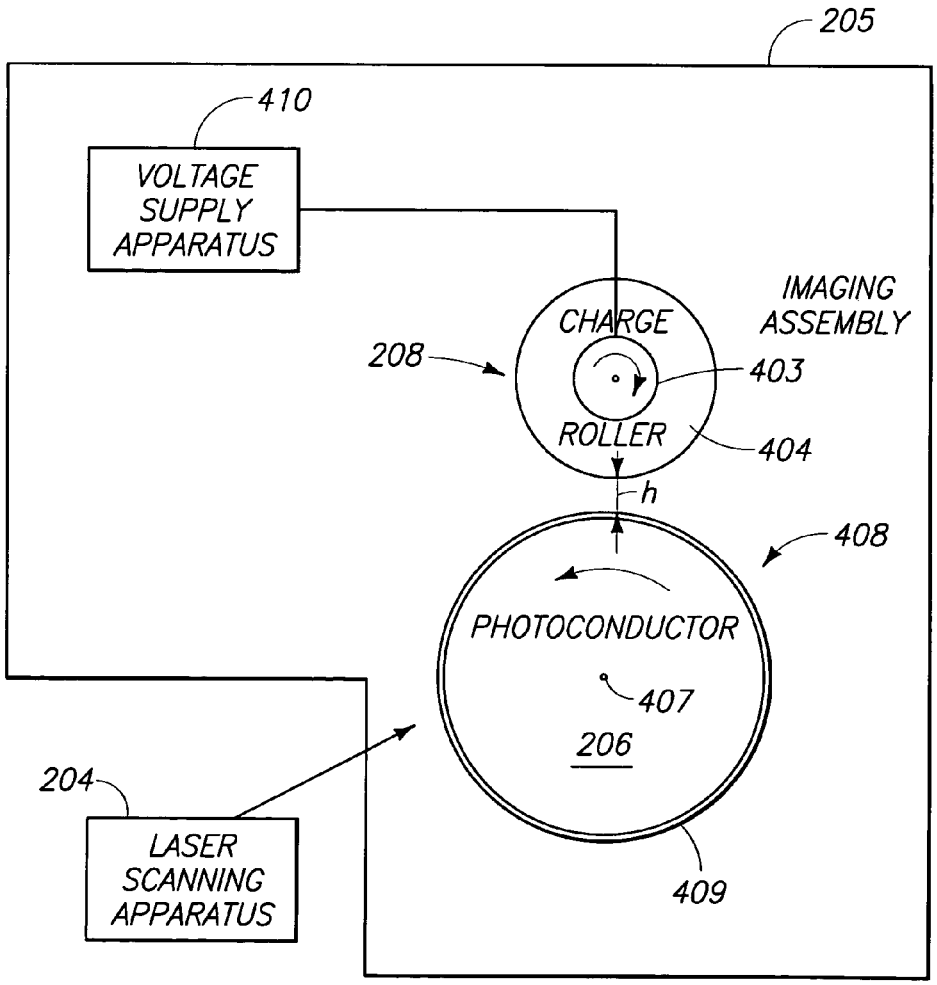
FIG. 4 is a functional schematic illustrating charging of a photoconductor using a charging device according to one embodiment.

FIG. 4 is a functional schematic illustrating exemplary electrophotography aspects. For example, charging of a photoconductor 206 using a charge roller 208 in accordance with one embodiment is shown.

As discussed further below in accordance with some embodiments, photoconductor 206 may include a plurality of different regions. The plural regions may correspond to imaging and non-imaging regions 408, 406 (FIG. 5A), respectively, of an outer surface of photoconductor 206 having different radii or otherwise spaced different distances from a central axis 407. In one embodiment, photoconductive material of photoconductor 206 may be provided in a layer 409 about a cylinder. In one embodiment, imaging region 408 of the photoconductor 206 is configured to form latent images during hard imaging operations of the hard imaging device 100 (FIG. 1).

The charge roller 208 may be positioned adjacent photoconductor 206 and configured to rotate about an axis to charge the photoconductor 206. The charge roller 208 may include a core member 403 (e.g., comprising a conductive material) and a layer of material 404 (e.g., high resistivity rubber) formed on the core member 403. The core member 403 may be configured to receive a voltage from voltage supply apparatus 410 to enable charging of the photoconductor 206. In one embodiment, the charge roller 208 is positioned such that a predetermined clearance "h" is provided between the charge roller 208 and the photoconductor 206 during charging of the photoconductor 206.

A Paschen curve describes air ionization breakdown voltages as a function of the clearance "h" between exposed electrodes. In one embodiment, layer 404 of charge roller 208 and layer 409 of photoconductor 206 act as the electrodes for charging the photoconductor 206. A voltage Vg in the clearance "h" depends on the splitting of charge roller voltage $V_{CR}$ between the photoconductive material layer 409 and the clearance "h". The voltage Vg is provided by the following equation:

$$V_g = (V_{cr} - V_{photo} - V_{elastomer}) \cdot \frac{h}{h + \frac{L_{photoconductor}}{\varepsilon_{photoconductor}}}$$

where "$V_{cr}$" is the metal core voltage of charge roller 208; "$V_{photo}$" is the charge voltage of photoconductor 206; "$V_{elastomer}$" is the voltage drop across elastomer or rubber layer 404; "h" is a clearance between exposed electrodes (e.g., a gap between electrodes comprising photoconductive material layer 409 and the charge roller 208); "e" is the dielectric constant of layer 409 of the photoconductor 206; and L is the thickness of photoconductive material layer 409 of the photoconductor 206.

Figure 5A:
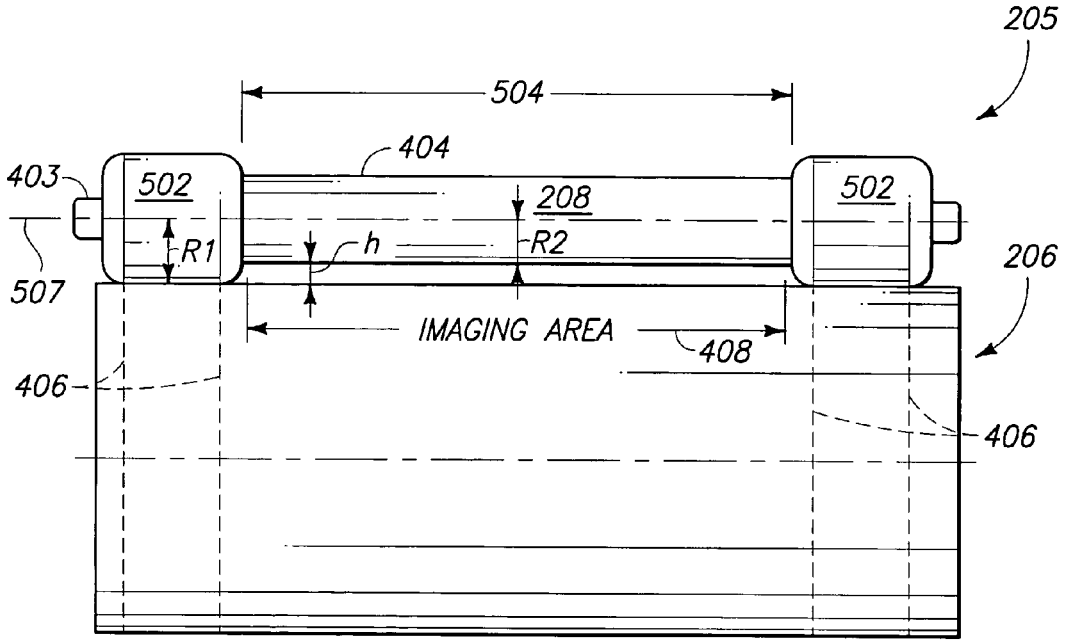
FIGS. 5A–5C show exemplary arrangements configured to provide a clearance between a charging device and a photoconductor according to exemplary embodiments.
Figure 5B:
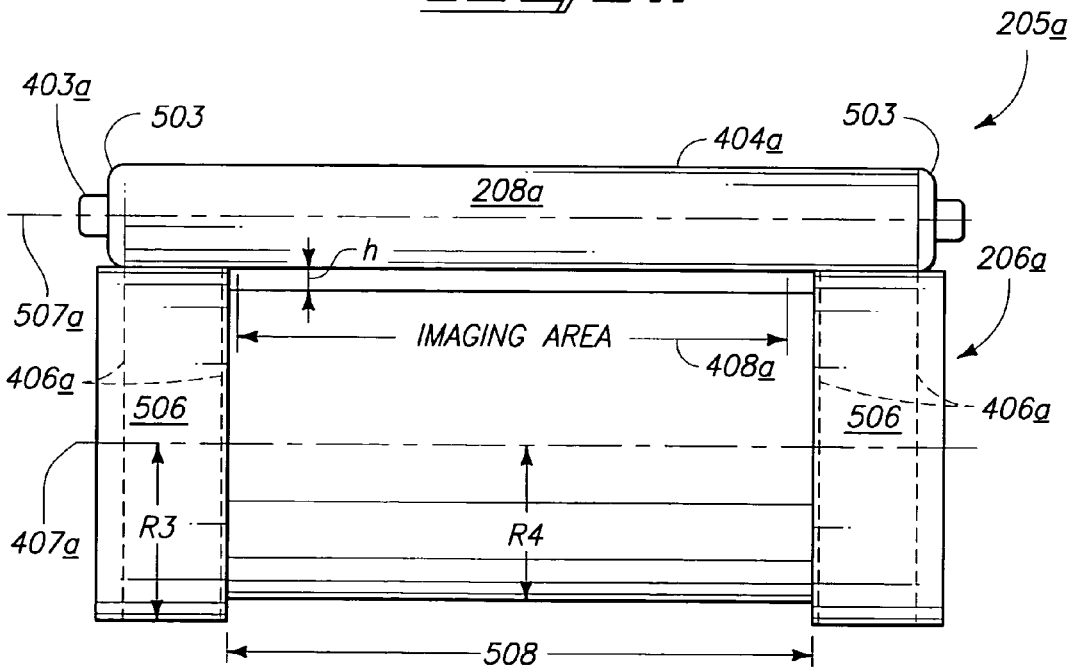
Figure 5C:
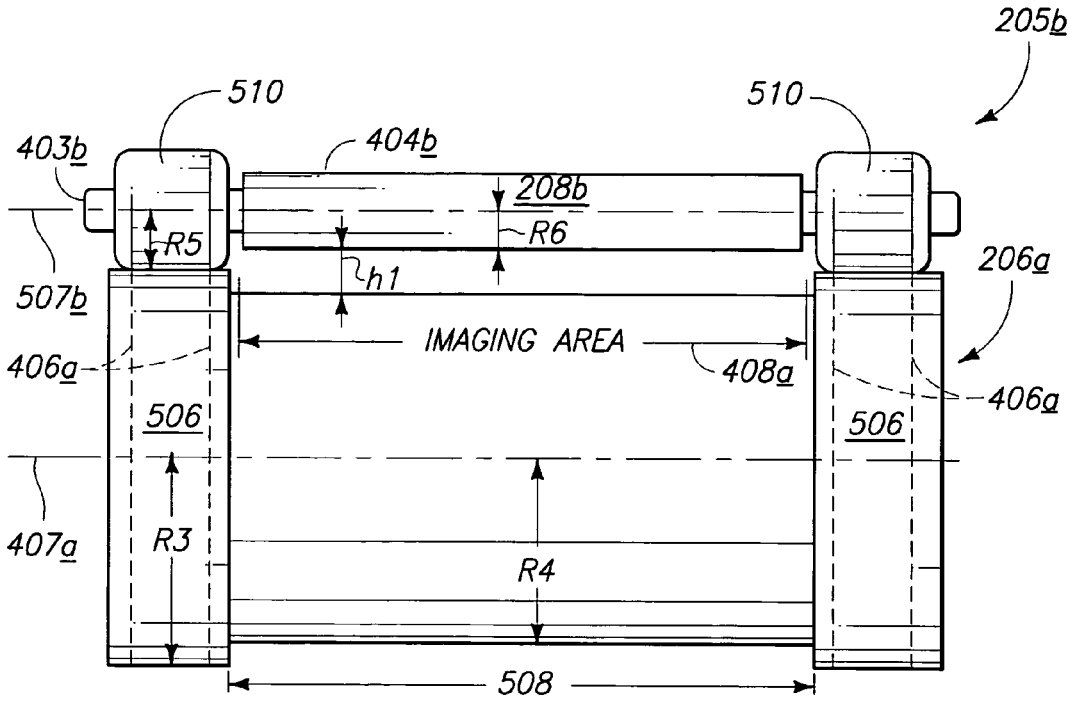

FIGS. 5A–5C show respective exemplary arrangements of imaging assemblies 205, 205*a*, 205*b* to provide clearances between a photoconductor and a charge roller in order to charge the photoconductor according to various exemplary embodiments.

Referring to FIG. 5A, an exemplary arrangement of an imaging assembly 205 is shown. Imaging assembly 205 includes a charge roller 208 having a core member 403 coated with layer 404 (e.g., high resistivity rubber or elastomer) such that end portions or members 502 of layer 404 are formed to have a larger radius R1 than a radius R2 of an intermediate portion or member 504 of layer 404, the radii being measured from a central axis 507 of the charge roller 208. The end portions 502 of the charge roller 208 contact and ride adjacent to regions 406 of the photoconductor 206 while maintaining a clearance "h" between the intermediate portion 504 of the charge roller 208 and region 408 of the photoconductor 206. In one embodiment, intermediate portion 504 of charge roller 208 and imaging region 408 of photoconductor 206 may be of equal lengths.

Photoconductor 206 may be made by forming a plurality of layers (not shown) on a cylindrical drum. Exemplary layer 409 of material coated on the cylindrical drum to form the photoconductor 206 may include Mylar, aluminum, a charge generating layer, and/or a charging transport layer. The plurality of regions (e.g., imaging and non-imaging regions 408, 406, respectively) of the photoconductor 206*a* may be made from a continuous monolithic layer of material (e.g., layer 409 (FIG. 4)), and non-imaging regions 406 may additionally be rendered electrically insulative by anodizing conductive material (e.g., aluminum) present in such regions of layer 409 of the photoconductor 206.

In one embodiment, end portions 502 and intermediate portion 504 of layer 404 of charge roller 208 may be formed as a continuous layer (e.g., a monolithic layer of high resistivity rubber) of material about a core member 403. For example, the charge roller 208 may include a monolithic layer 404 configured to charge the photoconductor 206, and the layer 404 may be formed such that the end portions 502 have a larger radius than a radius of the intermediate portion 504.

Referring to FIG. 5B, another exemplary arrangement of imaging assembly 205*a* to provide a clearance "" between layer 404*a* of charge roller 208*a* and photoconductor 206*a* is shown, and wherein like elements are identified using like numerals, but with a suffix "a" added. Photoconductor 206*a* may be formed as described above at FIG. 5A, but further includes a plurality of portions (e.g., end portions 506 and intermediate portion 508) made from a continuous layer (e.g., layer 409 of FIG. 4) of material formed to have different radii (e.g., R3 and R4) measured from a central axis 407*a* of the photoconductor 206*a*. The first and second end portions 506, also referenced as reference disks, include non-imaging regions 406*a* and intermediate portion 508 includes an imaging region 408*a*. In the depicted example of FIG. 5B, non-imaging regions 406*a* are laterally outwardly of imaging region 408*a*, and non-imaging regions 406*a* may be rendered electrically insulative as described above at FIG. 5A.

Continuing to refer to FIG. 5B, the charge roller 208*a* having a core member 403*a* is made as a cylindrical member having uniform radius measured from a central axis 507*a* of charge roller 208*a*. The first and second ends 503 of the charge roller 208*a* are configured to contact and ride on end portions 506 of the photoconductor 206*a* while a clearance "h" is maintained between region 408*a* of the photoconductor 206*a* and charge roller 208*a* in the depicted exemplary embodiment.

Referring to FIG. 5C, another exemplary arrangement of imaging assembly 205*b* to provide a different clearance "h1" between layer 404*b* of charge roller 208*b* and imaging region 408*a* of photoconductor 206*a* is shown, and wherein like element are identified using like numerals, but with a suffix "b" added. Charge roller 208*b* of imaging assembly 205*b* may include a plurality of wheels 510 (e.g., wheels 510 may comprise drive members or rollers). Wheels 510 are received by core member 403*b* of the charge roller 208*b*. Wheels 510 have a radius R5 that is greater than the radius R6 of layer 404*b* and core member 403*b* of the charge roller 208*b*, the radii being measured from a central axis 507*b* of the charge roller 208*b*. Wheels 510 are configured to contact and ride adjacent to respective surfaces of end portions 506 of the photoconductor 206*a*, thereby providing a clearance "h1" between layer 404*b* of charge roller 208*b* and imaging region 408*a* of photoconductor 206*a*. End portions 506 of photoconductor 206*a* may be rendered electrically insulative as described above at FIG. 5B.

As illustrated in the exemplary embodiments of FIGS. 5A–5C, the arrangements of charge roller 208 and photoconductor 206 may be varied to provide different design clearances "h" and "h1" between layer 404 and imaging region 408.

Figure 6:
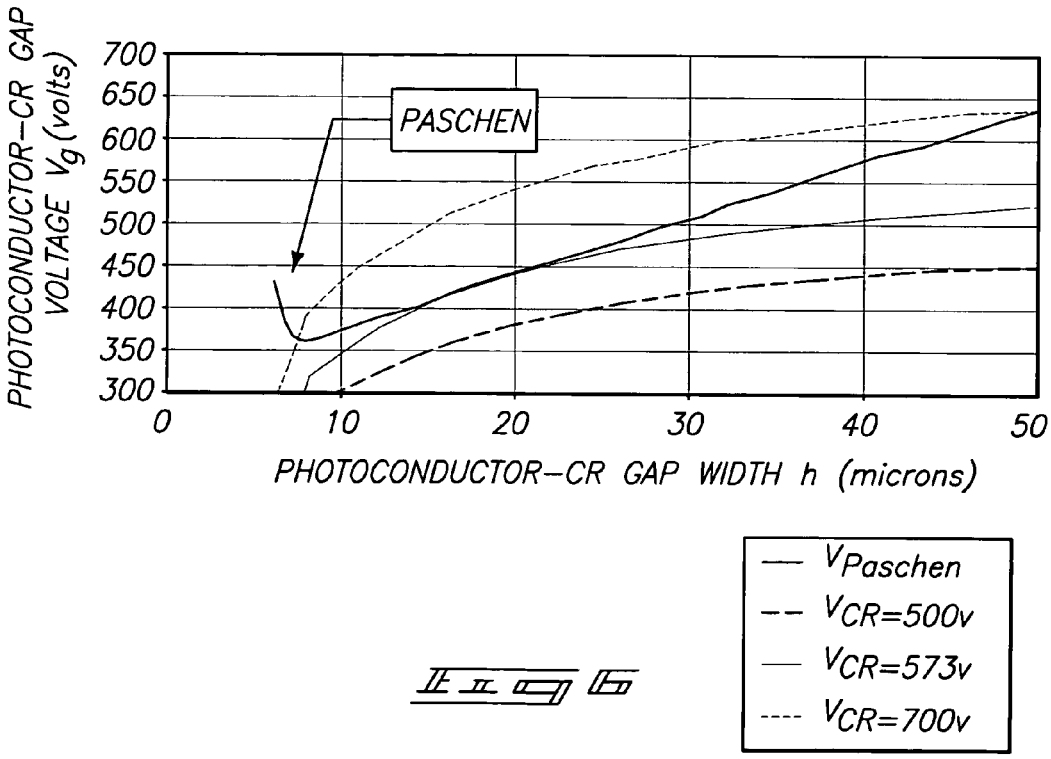
FIG. 6 is a graph illustrating photoconductor to charging device clearance versus voltage in the clearance according to one embodiment.

FIG. 6 is an exemplary graph showing Vg as a function of the clearance "h" for three exemplary charge roller voltages ($V_{CR}$). The illustrated Paschen curve shows minimal voltage required for air ionization. For each $V_{CR}$, ionization was observed to occur for clearances "h" as indicated in the graph, where Vg^VPaschen.

As shown in the graph, the inventors have observed that no ionization occurred for $V_{CR}$=500V for all clearances "h". Minimal $V_{CR}$ where ionization occurred was found to be 573V with an associated clearance h=19 microns, referred to herein as the charging clearance, for exemplary photoconductors described herein. The charging clearance corresponds to a maximum spaced distance "h" between charge roller 208 and the photoconductor 206 wherein the charging efficiency is substantially the same as if the charge roller 208 contacts the photoconductor 206. Typically, the charging clearance is about 19 microns with minor variations depending on such factors as the characteristics of the photoconductor layer 409, and air pressure and humidity in the charging environment, etc. Charging efficiency decreases in arrangements wherein the distance "h" exceeds this charging clearance.

For $V_{CR}$=700V, the inventors have observed that ionization started at a clearance "h" of 50 microns and continued until the clearance "h" was decreased to about 8 microns. Once ionization begins, the surface of the photoconductor 206 attracts charges and counter charges, thereby increasing its surface voltage. However, surface voltage of the charge roller 208 was not found to have significantly changed due to the attraction of counter charges as charge roller 208 was made conductive. Hence, the voltage Vg within the clearance "h" may be reduced until the voltage reaches the Paschen value for a given clearance "h". As the clearance "h" is reduced for different designs of the photoconductor and charge roller, increased ionization occurs (e.g., due to lower Paschen voltage limit) thereby increasing charge on photoconductor 206 until the charging clearance is reached. The voltage Vg was found to be pinned to the Paschen curve until the clearance "h" reached a predetermined clearance (e.g., charging clearance). As mentioned previously, the charging clearance was observed to be about 19 microns in exemplary embodiments.

In one exemplary case, the inventors have observed that if the clearance "h" drops below the charging clearance, no additional charging of the photoconductor 206 occurred as the $V_{CR}$ split drops Vg below the Paschen curve due to accumulated charges on the surface of the photoconductor 206. In one example, the charge roller 208 was observed to charge the photoconductor 206 to a maximum voltage only up to the charging clearance, and no additional charging of the photoconductor 206 occurred with clearances below the charging clearance. For the above-noted example, charging efficiency of the photoconductor 206 obtained at the charging clearance remained the same for all clearances "h" less than the charging clearance (e.g., from 19 microns to 0 microns), and the photoconductor 206 has been charged to its maximum potential (e.g., Charge Roller voltage −573V) at about the charging clearance.

The charging efficiency of the photoconductor 206 with clearance "h" between the charge roller 208 and the photoconductor 206 may be compared with the charging efficiency where the charge roller 208 contacts the photoconductor 206, and the results are shown in the below table:

| | Power supply | Charging efficiency | Charging uniformity |
|---|---|---|---|
| Ref-touching CR | 1040 V DC ± 700 V AC, 6 kHz | 960 V | 11 V PTP |
| Non-touching CR | 1040 V DC ± 700 V AC, 6 kHz | 950 V | 10 V PTP |

As can be seen from the above Table I, even though no contact is established between the charge roller 208 and the photoconductor 206 and a clearance "h" is maintained between the charge roller 208 and the photoconductor 206, the charging efficiency of the photoconductor 206 remained uniform. Moreover, the charging uniformity is improved by maintaining a clearance "h" between the charge roller 208 and the photoconductor 206 compared to approaches wherein the charge roller contacts the photoconductor.

Exemplary advantages of some embodiments include providing a clearance between a charge roller and a photoconductor to reduce chances of damage to the charge roller due to contact with the photoconductor. Since no direct charging of the photoconductor occurs in embodiments having a clearance between the charge roller and the photoconductor, increased charging uniformity in both in-scan and cross-scan directions may be possible. Solutions provided by some embodiments provide a charging system which is more robust to misalignments and material defects during manufacturing. Other advantages of using a spaced charge roller to charge a photoconductor include efficiencies related to cost, size, and Ozone generation rate.

The protection sought is not to be limited to the disclosed embodiments, which are given by way of example only, but instead is to be limited only by the scope of the appended claims.

What is claimed is:

1. A hard imaging apparatus charging device comprising:

first and second end members; and an intermediate member connecting the first and second end members and positioned adjacent to an imaging area of an image bearing member of a hard imaging apparatus, the intermediate member configured to charge the imaging area used to form latent images on the image bearing member during hard imaging operations of the hard imaging apparatus, wherein the first and second end members are configured to maintain a predetermined spaced charging clearance between the intermediate member and the imaging area of the image bearing member; and wherein the first and second end members and the intermediate member comprise a monolithic layer.

2. The device of claim 1, wherein the charging device comprises an outer layer configured to charge the image bearing member, and wherein the layer is formed such that the first and second end members have a larger radius than a radius of the intermediate member.

3. The device of claim 1, further comprising:

a member for receiving a voltage from a voltage supply to create ionization between the charging device and the image bearing member to charge the image bearing member.

4. The device of claim 1, wherein the charging device is configured as a rotatable charge roller.

5. The device of claim 1, wherein a radius of the intermediate member is smaller than a radius of the first and second end members.

6. The device of claim 5, wherein the first and second end members of the charging device are configured to contact a non-imaging area of the image bearing member to provide the charging clearance between the intermediate member and the imaging area of the image bearing member.

7. The device of claim 1 wherein a length of the intermediate member is substantially the same as an imaging area of the image bearing member.

8. An imaging assembly comprising:

a cylindrical image bearing member configured to form latent images during hard imaging operations using the imaging assembly, the image bearing member comprising:

first and second end portions corresponding to non-imaging areas of the image bearing member;

an intermediate portion connecting the first and second end portions, the intermediate portion comprising an imaging area of the image bearing member; and wherein the imaging area and the non-imaging area having different radii from a central axis of the image bearing member; and a charging device configured to charge the image bearing member while maintaining a charging clearance intermediate the charging device and the imaging area of the image bearing member, and wherein the charging device comprises:

first and second end members configured to contact the non-imaging areas of the image bearing member; and an intermediate member connecting the first and second end members and configured to maintain a clearance with the imaging area of the image bearing member.

9. The assembly of claim 8, wherein the first and second end portions and the intermediate portion of the image bearing member are made from a monolithic layer of material.

10. The assembly of claim 8, wherein the first and second end portions are configured to be removably attached to the intermediate portion of the image bearing member.

11. The assembly of claim 8, further comprising:

a member of the charging device configured to receive a voltage from a voltage supply apparatus to create ionization between the charging device and the image bearing member to charge the image bearing member.

12. The assembly of claim 8, wherein the charging device is configured as a rotatable charge roller.

13. The assembly of claim 8, wherein the intermediate member of the charging device has a length corresponding to a length of the imaging area of the image bearing member.

14. An imaging assembly comprising:

a charging device configured to rotate about a first axis and having a plurality of portions comprising plural different radii;

a photoconductor configured to rotate about a second axis substantially parallel to the first axis and comprising a plurality of portions comprising plural different radii; and wherein the charging device is configured to charge the photoconductor in a spaced relationship with respect to the photoconductor, and a portion of the photoconductor having an increased radius compared with another portion of the photoconductor is aligned with a portion of the charging device having an increased radius compared with another portion of the charging device.

15. The imaging assembly of claim 14, wherein the plurality of portions of the charging device individually having a radius greater than another portion of the charging device comprise drive members.

16. The imaging assembly of claim 14 wherein the aligned portions of the charging device and the photoconductor contact one another during charging of the photoconductor by the charging device.

17. The imaging assembly of claim 14 wherein the aligned portions of the charging device and the photoconductor provide the spaced relationship of the charging device and the photoconductor.

18. The imaging assembly of claim 14 wherein the another portion of the charging device is configured to charge the photoconductor.

19. An imaging assembly comprising:

an image bearing member comprising:

first and second end portions corresponding to non-imaging areas of the image bearing member; and an intermediate portion connecting the first and second end portions, the intermediate portion corresponding to an imaging area of the image bearing member, and wherein the first and second end portions and the intermediate portion have different radii from a central axis of the image bearing member;

a charging device configured to charge the image bearing member, comprising:

first and second rollers, and an intermediate member connecting the first and second rollers; and the first and second rollers further configured to contact the first and second end portions of the image bearing member, respectively; and wherein the first and second rollers and the first and second end portions of the image bearing member are configured to provide a predetermined spaced clearance between the intermediate member of the charging device and the imaging area of the image bearing member during charging of the image bearing member.

20. The assembly of claim 19, wherein the first and second rollers have a larger radius than a radius of the intermediate member of the charging device.

21. The assembly of claim 19, wherein the intermediate member of the charging device and the intermediate portion of the image bearing member have equal lengths.

22. An image assembly comprising:

image bearing means for forming latent images during hard imaging operations using the imaging assembly, the image bearing means comprising:

first and second end portion means corresponding to non-imaging areas of the image bearing means;

intermediate portion means for connecting the first and second end portion means, the intermediate portion means comprising an imaging area of the image bearing means; and wherein the intermediate portion means and the first and second end portion means have different radii measured from a central axis of the image bearing means; and charging means spaced from the imaging area and comprising means for charging the imaging area and further comprising a plurality of portions having different radii and wherein a portion of the charging means having an increased radius compared with another portion of the charging means contacts a portion of the image bearing means having an increased radius compared with another portion of the image bearing means.

23. An imaging assembly charging method comprising:

first providing a photoconductor;

second providing a charging device to charge the photoconductor and the charging device comprising a monolithic member including a plurality of portions of different radii;

rotating the photoconductor adjacent the charging device to charge the photoconductor; and third providing a clearance between the photoconductor and the charging device during charging of the photoconductor, and wherein the clearance is provided using at least one of the portions of the charging device.

24. The method of claim 23, wherein the first providing comprises:

configuring the photoconductor to have first and second end portions and an intermediate portion, and wherein the first and second end portions have a larger radius than a radius of the intermediate portion, the radii measured from a central axis of the photoconductor.

25. The method of claim 24, wherein the first and second end portions correspond to non-imaging areas of the photoconductor, and the intermediate portion corresponds to an imaging area of the photoconductor.

26. The method of claim 23 wherein the photoconductor comprises a plurality of portions of different radii.

27. The method of claim 26 wherein a portion of the photoconductor having an increased radius compared with another portion of the photoconductor is aligned with a portion of the charging device having an increased radius compared with another portion of the charging device.

28. The method of claim 27 wherein the another portion of the charging device is configured to charge the photoconductor.

29. A hard imaging device image bearing member charging method comprising:

providing a charging device having first and second end members and an intermediate member connecting the first and second members in an arrangement configured to charge an image bearing member, wherein the first and second end members and the intermediate member are made from a continuous layer of material of the charging device;

first configuring the intermediate member to have a length substantially corresponding to an imaging area of the image bearing member, the intermediate member configured to charge the imaging area used to form latent images on the imaging bearing member during hard imaging operations of a hard imaging device; and second configuring the first and second end members of the charging device to maintain a clearance between the intermediate member and the imaging area of the image bearing member.

30. The method of claim 29, wherein the second configuring comprises forming the first and second end members to have a larger radius than a radius of the intermediate member, the radii measured from a central axis of the charging device.

31. The method of claim 29, further comprising:

configuring the image bearing member to have first and second end portions and an intermediate portion, the intermediate portion having a smaller radius than a radius of the first and second end portions, the radii measured from a central axis of the image bearing member;

configuring the intermediate portion to comprise the imaging area of the image bearing member; and configuring the first and second portions to comprise non-imaging areas of the image bearing member.

32. The method of claim 29, wherein the providing comprises:

configuring the first and second end members with first and second rollers, respectively, the first and second rollers having a larger radius than a radius of the intermediate member; and contacting the first and second rollers with first and second portions, respectively, of the image bearing member, during charging of the image bearing member using the charging device.

33. An imaging assembly comprising:

a cylindrical image bearing member configured to form latent images during hard imaging operations using the imaging assembly, the image bearing member comprising:

first and second end portions corresponding to non-imaging areas of the image bearing member;

an intermediate portion connecting the first and second end portions, the intermediate portion corresponding to an imaging area of the image bearing member;

wherein the imaging area and the non-imaging area having different radii from a central axis of the image bearing member; and wherein the first and second end portions are configured to be removably attached to the intermediate portion of the image bearing member.

34. An imaging assembly comprising:

a cylindrical image bearing member configured to form latent images during hard imaging operations using the imaging assembly, the image bearing member comprising:

first and second end portions corresponding to non-imaging areas of the image bearing member;

an intermediate portion connecting the first and second end portions, the intermediate portion corresponding to an imaging area of the image bearing member;

wherein the imaging area and the non-imaging area having different radii from a central axis of the image bearing member; and wherein an intermediate member of a charging device has a length corresponding to a length of the imaging area of the image bearing member.

35. An imaging assembly charging method comprising:

first providing a photoconductor having a plurality of portions of different radii;

second providing a charging device to charge the photoconductor;

rotating the photoconductor adjacent the charging device to charge the photoconductor;

third providing a clearance between the photoconductor and the charging device during charging of the photoconductor, and wherein the clearance is provided using at least one of the photoconductor or the charging device; and wherein the second providing comprises:

configuring the charging device to have a plurality of portions of different radii; and forming the plurality of portions from a monolithic layer.

* * * * *